US005349423A

United States Patent [19]

Nagato et al.

[11] Patent Number: 5,349,423

[45] Date of Patent: Sep. 20, 1994

[54] RECORDING APPARATUS AND HEATING APPARATUS FOR USE IN RECORDING APPARATUS

[75] Inventors: Hitoshi Nagato, Tokyo; Yuzo Koike, Yokohama, both of Japan

[73] Assignee: Kabushiki Kaisha Toshiba, Kawasaki, Japan

[21] Appl. No.: 944,264

[22] Filed: Sep. 14, 1992

Related U.S. Application Data

[63] Continuation-in-part of Ser. No. 832,699, Feb. 7, 1992, abandoned.

[30] Foreign Application Priority Data

Mar. 16, 1991 [JP] Japan ..... 3-75559
Mar. 10, 1992 [JP] Japan ..... 4-051685

[51] Int. Cl.[5] ..... G03G 15/20
[52] U.S. Cl. ..... 355/285; 219/470; 355/289; 355/290
[58] Field of Search ..... 355/282, 285, 289, 290; 219/469, 470, 471

[56] References Cited

U.S. PATENT DOCUMENTS 3,883,213 5/1975 Glaister ..... 339/DIG. 3 X
4,825,041 4/1989 Nagumo et al. ..... 219/470 X
5,084,738 1/1992 Ishikawa ..... 355/285
5,115,279 5/1992 Nishikawa et al. ..... 355/290

*Primary Examiner*—Michael L. Gellner
*Assistant Examiner*—P. Stanzione
*Attorney, Agent, or Firm*—Oblon, Spivak, McClelland, Maier & Neustadt

[57] ABSTRACT

A heating apparatus includes a heating apparatus including a heating member having a structure in which a combination of a pressure-sensitive conductive switching layer a region of which can be conducted upon being pressed and a heat-generating resistor layer are sandwiched between first and second conductors. Alternatively, a recording apparatus includes a power supply member having a first electrode and a second electrode aligned with the first electrode, and a conductive member which is in slidable contact with the power supply member, wherein a voltage is applied across the first and second electrodes, so that a current flows in the heat-generating resistor layer or the conductive toner image to generate Joule heat, thereby fixing the toner image by using the Joule heat.

16 Claims, 9 Drawing Sheets

RECORDING APPARATUS AND HEATING APPARATUS FOR USE IN RECORDING APPARATUS

CROSS-REFERENCE TO THE RELATED APPLICATIONS

This application is a continuation-in-part, of U.S. patent application Ser. No. 832,699, filed on Feb. 7, 1992, now abandoned.

BACKGROUND OF THE INVENTION

1. Field of the Invention

The present invention relates to a recording apparatus of electrophotographic recording in which the power required for fixing is reduced.

2. Description of the Related Art

An electrophotographic recording apparatus has features such that it produces less noise as it is a non-impact recording apparatus, it can record characters clearly, its recording speed is high, and its running cost is relatively low. Therefore, it is recently used as an output terminal of OA equipment. The market of the electrophotographic recording apparatus is also quickly widening.

FIG. 1 is a schematic diagram of a recording apparatus of a laser printer as an example of the electrophotographic recording apparatus. The outline of the electrophotographic recording apparatus will be described. A conventional electrophotographic recording apparatus uses a photosensitive drum 100, as shown in FIG. 1. The entire surface of the photosensitive drum 100 is first uniformly charged to, e.g., about −700 V with negative charges by a charging apparatus 101 comprising a corona charger. Then, the photosensitive drum 100 is irradiated with a laser beam 102 in accordance with an image signal. The resistance of a portion of a photosensitive material which is irradiated with the beam is decreased. Therefore, an electrostatic latent image in which the negative charges are erased is formed at the portion irradiated with the laser beam 102. Usually, one semiconductor laser is used as the laser, and the beam modulated in accordance with the image performs scanning by a rotating polygonal mirror.

The electrostatic latent image formed in this manner is then developed by a developing apparatus 103. That is, when a developing bias of about −500 V is applied to the developing roller, a toner as fine color particles charged with, e.g., negative charges by reversal development attaches to the portion of the electrostatic latent image on the photosensitive drum 100 in which the negative charges are erased, thereby visualizing the latent image. Then, recording paper 105 which is picked up by paper feed rollers 104 from a paper cassette (not shown) is conveyed in synchronism with an image signal, and contacts the photosensitive drum 100. Transfer of the visualized toner image to the recording paper 105 is performed. In a transfer charger 106, positive charges are applied to, e.g., the lower surface of the recording paper 105. Thus, the negatively charged toner image on the photosensitive drum 100 is attracted to the recording paper 105 and transferred to it. The image-transferred recording paper 105 is then separated from the photosensitive drum 100 by a separation charger 107.

Finally, the toner is heated and pressed by a fixing apparatus 111 having a heat roller 110 and fixed on the recording paper 105, thereby completing recording. Note that part of the toner which is not transferred to the recording paper 105 remains on the photosensitive drum 100. The remaining toner on the drum 100 is cleaned by being scraped by a cleaner having a cleaning blade 108. Thereafter, the entire surface of the drum 100 is exposed to light by an erasure lamp 109 comprising an LED or the like, thereby erasing the charges on the photosensitive drum 100.

In this manner, in the electrophotographic recording apparatus, the steps of charging, formation of a latent image, development, transfer, and fixing are performed to form an image. The drum is cleaned in the cleaning step and is repeatedly used. Processes may differ more or less depending on the types of apparatuses but basically include the above steps.

The laser printer has been briefly described as a typical example of the electrophotographic recording apparatus. As the electrophotographic recording apparatus, not only a laser printer but also a recording head which uses other light-emitting elements for writing an electrostatic latent image have been developed and marketed. In the laser printer, a beam generated by one laser is radiated onto a polygonal mirror which rotates mechanically at a high speed or a hologram to scan the dots. A solid state scanning method which uses an array light source in view of reduction in system size and cost also currently has begun to attract attention. For example, an electrophotographic recording apparatus with a head in which light-emitting elements, e.g., LEDs, liquid crystal shutters. EL elements, plasma light-emitting elements, and fluorescent dot array, or light-shutter elements are arranged in an array has been put into practical use. Either electrophotographic recording apparatus described above is generally called an optical printer and utilized as an output apparatus, e.g., a printer or a digital copying machine. Another example of the electrophotographic recording apparatus is an analog copying machine in which the original is irradiated with light from, e.g., a conventionally used fluorescent lamp, and the light reflected by the original is guided to the photosensitive member to form an electrostatic latent image, thereby copying the original. Furthermore, another recording method called ion flow recording or ion deposition recording is also available. According to this method, a dielectric material is used in place of a photosensitive number. Ions are blown from pores formed in an array manner. An electrostatic latent image is formed on the dielectric material by the ions.

As has been described above, since the electrophotographic recording apparatuses have excellent features, they are often utilized recently as output terminal apparatuses of OA equipment. Various methods for them are developed and put into practical use, with their market rapidly expanding.

In these electrophotographic recording apparatuses, recording is performed in the common steps of charging, formation of a latent image, development, transfer, and fixing, as described above. One of the characteristic features of the electrophotographic recording apparatus is that a very low energy is required for forming an electrostatic latent image. For example, to form a latent image of one dot, a light energy of as small as about $10^{-6}$ to $10^{-5}$ J/cm$^2$ is applied to the photosensitive member. In contrast to this, to form one dot on a recording material by, e.g., a thermal transfer recording apparatus, a large recording energy of about 2 to 6 J/cm$^2$ is required. If only these facts are considered, an electrophotographic recording apparatus seems to have a very high efficiency and its power consumption seems to be very low compared to those of a thermal transfer recording apparatus.

In an actual electrophotographic recording apparatus, however, the power consumption is normally about 1.5 Kw in an apparatus which can record 8 to 12 sheets per minute. and is about 500 to 600 W at minimum in a low-speed apparatus which can record 4 sheets per minute. These values are of the same level or higher when compared with a thermal transfer recording apparatus. In the electrophotographic recording apparatus, some of the recording processes from charging to transfer of a toner image on plain paper are certainly realized with a very low energy. However, a high energy is consumed in the final step of fixing the toner to the recording material. Therefore, the power consumption as a whole in the electrophotographic recording apparatus is increased. For example, the fixing energy is as large as about several tens of $J/cm^2$, which is about ten times the recording energy of the thermal transfer recording apparatus.

Most electrophotographic recording apparatuses use a heat roll type fixing apparatus which performs fixing by heat and pressure. The fixing apparatus which uses a heat roll is safe as it is free from a danger such as ignition. Since the heat capacity is large, stable image quality can always be obtained. The fixing intensity is sufficiently higher than that of pressure fixing and the like.

However, since the heat roll has a large heat capacity, it takes time to increase the temperature of the heat rolls to a value required for fixing. Therefore, the apparatus cannot be used immediately after turning on the switch, and a warm-up time of about several minutes is usually necessary. Since the heat roll has a large heat capacity, a heater having high power consumption is needed, and thus, e.g., an infrared lamp of about 500 to 1,000 W is normally incorporated in the roller. In fine, the conventional electrophotographic recording apparatus uses a heat roll having a large heat capacity as the fixing apparatus. Therefore, although it has several advantages, it also has disadvantages in that high power consumption is needed and the warm-up time is long. When size reduction of the electrophotographic printing apparatus is considered, it is not preferable to use, as the fixing apparatus, a heat roll which has high power consumption and generates much heat.

SUMMARY OF THE INVENTION

The present invention has been made in view of the drawbacks of the conventional electrophotographic recording apparatus described above, and has as its object to provide an electrophotographic recording apparatus which requires low power consumption and a short warm-up time.

According to the first aspect of the present invention, there is provided a heating apparatus comprising heating means having a first conductor, a pressure-sensitive conductive switching layer formed on the first conductor and a region of which can be conducted upon being pressed, a heat-generating resistor layer formed on the pressure-sensitive conductive switching layer, and a second conductor formed on the heat-generating resistor layer, wherein the heating means and a material to be heated are partially brought into tight contact with each other, and a voltage is applied across the first and second conductors, so that a current flows in the pressed region of the pressure-sensitive conductive switching layer and a portion of the heat-generating resistor layer around the region to generate Joule heat, thereby heating the material to be heated by using the Joule heat.

According to the second aspect of the present invention, there is provided a recording apparatus comprising heating means having a first conductor, a pressure-sensitive conductive switching layer formed on the first conductor and a region of which can be conducted upon being pressed, a heat-generating resistor layer formed on the pressure-sensitive conductive switching layer, and a second conductor formed on the heat generating resistor layer, wherein the heating means and a recording material are partially brought into tight contact with each other, and a voltage is applied across the first and second conductors, so that a current flows in the pressed region of the pressure-sensitive conductive switching layer and a portion of the heat resistant layer around the region to generate Joule heat, thereby fixing a toner image on the recording material by using the Joule heat.

According to the third aspect of the present invention, there is provided a recording apparatus comprising heating means constituted by a fixing sheet having a first conductor, a pressure-sensitive conductive switching layer a region of which can be conducted upon being pressed, a heat-generating resistor layer formed on the pressure-sensitive conductive switching layer, and a second conductor formed on the heat-generating resistor layer, wherein the fixing sheet is partially brought into tight contact with a recording material, and a voltage is applied across the first and second conductors, so that a current flows in the pressed region of the pressure-sensitive conductive switching layer in order to generate Joule heat, thereby fixing a toner image on the recording material by using the Joule heat.

According to the fourth aspect of the present invention, there is provided a recording apparatus comprising power supply means having a first electrode and a second electrode aligned with the first electrode, and a conductive member which is in slidable contact with the power supply means, wherein the conductive member and a recording material having a toner image consist of a conductive toner are partially brought into contact with each other, and a voltage is applied across the first and second electrodes, so that a current flows to generate Joule heat in the conductive toner image or the conductive member, thereby fixing the toner image on the recording material by using the Joule heat.

In the recording apparatus of the present invention, a fixing means having a large heat capacity, such as a heating means, e.g., a heat roller need not be entirely heated, unlike in the conventional recording apparatus, and heat generated at only the pressed portion of the surface of the heating means is efficiently conducted to the toner to be fixed and the recording material around it. As a result, the fixing step can be executed by heat of several $J/cm^2$, and the power consumed by the initial fixing is decreased to about 1/10 that required by the conventional apparatus.

According to the present invention, since the contact portion of the heating means and the recording material or the conductive toner can be caused to generate heat instantaneously, the warm-up time can be set to almost 0 when the recording apparatus is used at a normal temperature.

According to the present invention, since the heating means employs a two-layer structure in which the function of the pressure-sensitive conductive layer and the function of the heat-generating resistor layer are separated, the contact portion of the heating means and the recording material can be caused to concentratedly generate heat instantaneously.

Also, according to the present invention, fixing can be performed only when an image is present. When only a portion of the recording material on which a toner image is present, or a portion around it is selectively heated, in this manner, the power consumption can be further decreased to about a fraction.

Assume that a pressure-sensitive conductive resin layer is used as the pressure-sensitive conductive switching layer of the heating means. Even if the temperature distribution of the resin surface of the powered pressed portion is not uniform more or less, if a heat-generating resistor having a small variation in heat generation is used, non-uniform fixing does not easily occur. Furthermore, since the pressure-sensitive conductive resin has a characteristic to self-control its temperature at an upper limit value, ignition or a sticking phenomenon that the toner is fused on the roller, both of which are caused by an excessive temperature increase, can be prevented.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The preferred embodiments of the present invention will be described with reference to the accompanying drawings.

The present invention has been made to solve the problems described above, and has four embodiments as follows.

According to the first embodiment of the present invention, there is provided a heating apparatus comprising heating means having a first conductor, a pressure-sensitive conductive switching layer formed on the first conductor and a region of which can be conducted upon being pressed, a heat-generating resistor layer formed on the pressure-sensitive conductive switching layer, and a second conductor formed on the heat-generating resistor layer, wherein the heating means and a material to be heated are partially brought into tight contact with each other, and a voltage is applied across the first and second conductors, so that a current flows in the pressed region of the pressure-sensitive conductive switching layer and a portion of the heat-generating resistor layer around the region to generate Joule heat, thereby heating the material to be heated by using the Joule heat.

According to the second embodiment of the present invention, there is provided a recording apparatus which fixes a toner image by using this heating apparatus.

Figure 1:
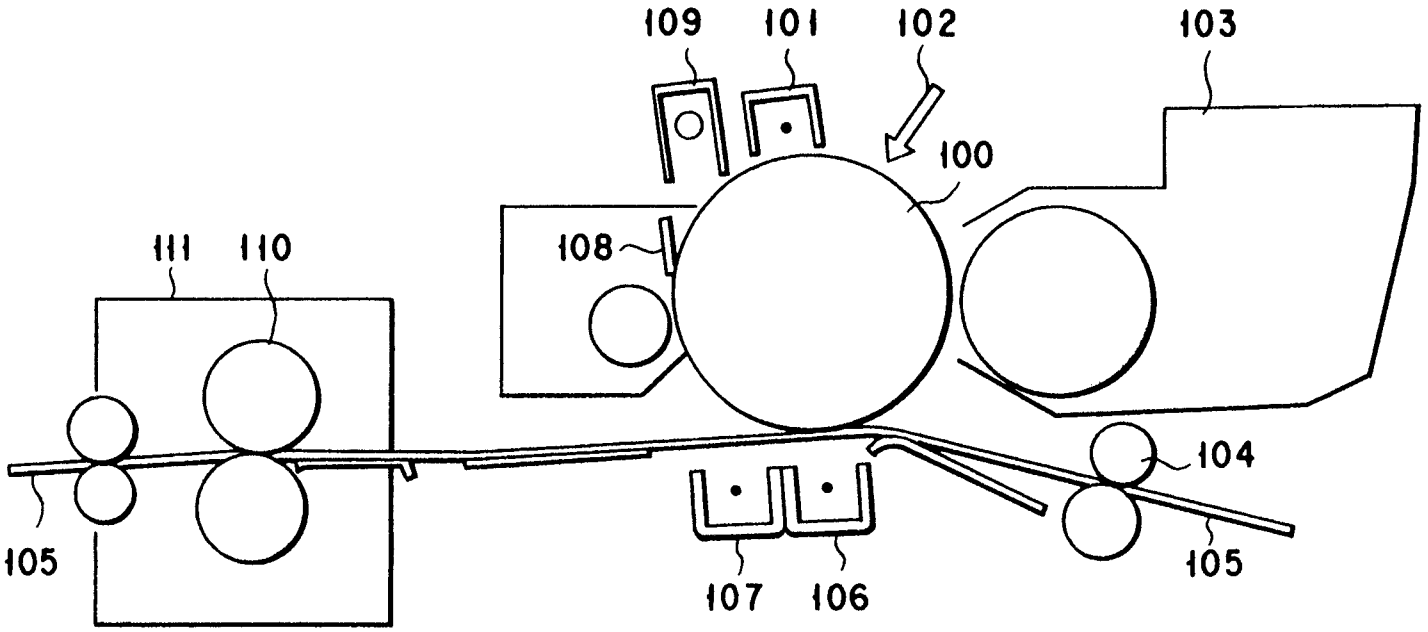
FIG. 1 schematically shows an arrangement of an electrophotographic recording apparatus having a recording apparatus using a conventional heat roller.
Figure 2A:
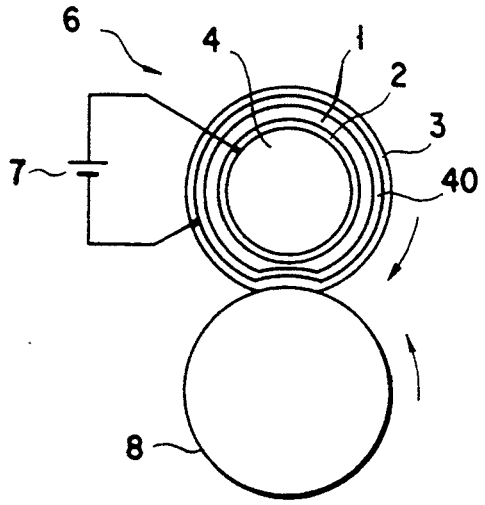
FIG. 2A schematically shows an arrangement of a fixing means using a heat-generating resistor and a pressure-sensitive resin.
Figure 2B:
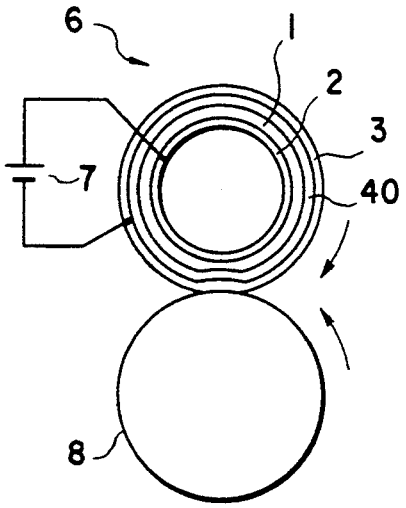
FIG. 2B schematically shows another arrangement of a fixing means using a heat-generating resistor and a pressure-sensitive resin.

FIGS. 2A and 2B are views for explaining a recording apparatus employing a two-layer structure comprising a switching layer and a heat layer according to the present invention. The fixing unit of this invention uses a pressure-sensitive conductive resin layer as the pressure-sensitive conductive switching layer. A first conductive layer 2 is formed on one surface of a pressure-sensitive conductive resin layer 1, a heat-generating resistor layer 40 is formed on the other surface of the pressure-sensitive conductive resin layer 1, and a second conductive layer 3 is formed on a surface of the heat-generating resistor layer 40 where the first conductive layer 2 is not formed. For practical usage, this structure is formed into a roller, as shown in FIG. 2A. A heat-insulating layer (not shown) is formed on a solid roller 4 which is made of a metal, a ceramic, or the like, or both of them. The first conductive layer 2 is formed on the heat-insulating layer, the pressure-sensitive conductive resin layer 1 is formed on the first conductive layer 2, the heat resistor 40 is formed on the pressure-sensitive conductive resin layer 1, and the second conductive layer 3 is formed on the heat-generating resistor 40, thus forming a heat roller 6. A power source 7 is connected between the first and second conductive layers 2 and 3 of the heat roller 6. The power source 7 serves to generate heat for fixing. Hence, it suffices if the power source 7 is connected between the first and second conductive layers 2 and 3 at least while fixing is performed. When a press roller 8 is brought into tight contact with the heat roller 6 having this arrangement, the fixing unit of the present invention can be constituted. That is, recording paper (not shown) on which a toner image is formed is fed from the right side of FIG. 2A to the heat and press rollers 6 and 8 which are rotating as they are pressed against each other, as indicated by arrows in FIG. 2A. The recording paper passes between the rollers 6 and 8, and the power source 7 is connected during this passage of the recording paper, thus constituting the fixing unit. FIG. 2B shows an arrangement similar to FIG. 2A except that an inner first conductive layer 2 is a hollow conductor having a thickness of about 1 mm and made of a metal and the like which also serves as the roller support member. With this arrangement, the heat-insulating layer can be omitted.

Figure 3:
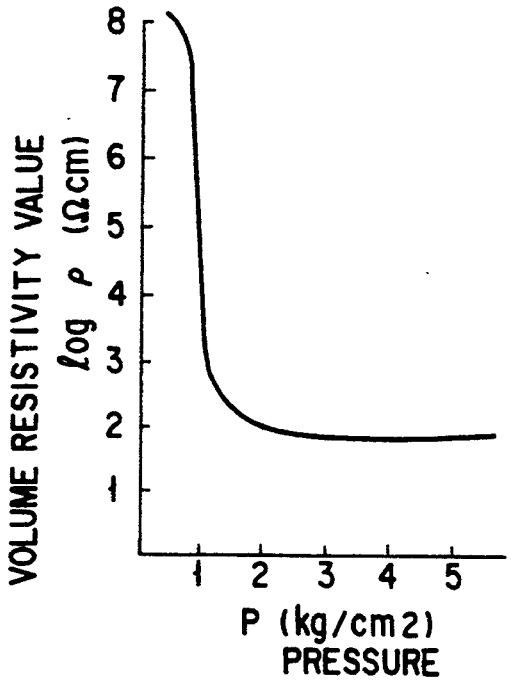
FIG. 3 is a graph showing a change in resistivity in a pressure-sensitive resin used in the present invention with regard to a pressure.

FIG. 3 is a graph showing an example of a pressure characteristic of the pressure-sensitive conductive resin layer 1. The axis of abscissa represents a pressure P ($kg/cm^2$) applied to the pressure-sensitive conductive resin layer 1, and the axis of ordinate represents a volume resistivity $\rho(\Omega\cdot cm)$ of the pressure-sensitive conductive resin layer 1 in logarithm. Usually, the volume resistivity $\rho$ of a pressure-sensitive conductive resin is greatly decreased on the order of ten times to hundred times upon application of a pressure of a certain degree, as shown in FIG. 3. One of the characteristic features of the recording apparatus of the present invention is that it uses this nature of the pressure-sensitive conductive resin.

When the heat roller 6 and the press roller 8 are brought into tight contact with each other, as shown in FIGS. 2A and 2B, a large pressure is applied to the pressed portion of the pressure-sensitive conductive resin layer 1. It is known from FIG. 3 that, if the pressure applied to the pressed portion of the heat and press rollers 6 and 8 is, e.g., 2 $kg/cm^2$, the volume resistivity $\rho$ of this portion is about $10^2\ \Omega\cdot cm$, in the same manner as in the first embodiment. Similarly, the volume resistivity $\rho$ of the non-pressed portion is about $10^8\ \Omega\cdot cm$. A volume resistivity $\rho h$ of the heat-generating resistor is $10^5\ \Omega\cdot cm$. Assuming that the diameter of the heat roller 6 is 16 mm (the roller circumference is about 5 cm), that the length is A4 (20 cm for the sake of simplicity), that the thickness of the pressure-sensitive conductive resin layer 1 is 1 mm, and that the thickness of the heat-generating resistant layer 40 is 100 $\mu m$, the total resistance (synthetic serial resistance) across the first and second conductive layers 2 and 3 will be calculated. When the heat roller 6 is not pressed by the press roller 8, a total resistance R0 across the first and second conductive layers 2 and 3 is:

$$R0 = (10^8 \times 0.1 + 10^5 \times 0.01)/(5 \times 20) = 100\ k\Omega \quad (1)$$

In contrast to this, assuming that the nip width is, e.g., 1 mm, a resistance R1 of a portion of the heat roller 6 pressed by the press roller 8 is:

$$R1 = (10^2 \times 0.1 + 10^5 \times 0.01)/(0.1 \times 20) = 500\ k\Omega \quad (2)$$

Thus, when the heat roller 6 is pressed, the total resistance R across the first and second conductive layers 2 and 3 is substantially equal to the resistance R1 of the pressed portion. That is, when a voltage from the power source 7 is applied, more than 99% (in this case) of the current is concentrated on the pressed portion, and about 99% of the voltage drop caused by this current is concentrated on the heat-generating resistor layer 40 to generate large Joule heat there. Since the heat-generating resistor layer 40 has a small heat capacity and close to the surface of the roller 6, the toner image on the recording paper is efficiently fixed by this heat.

Figure 4A:
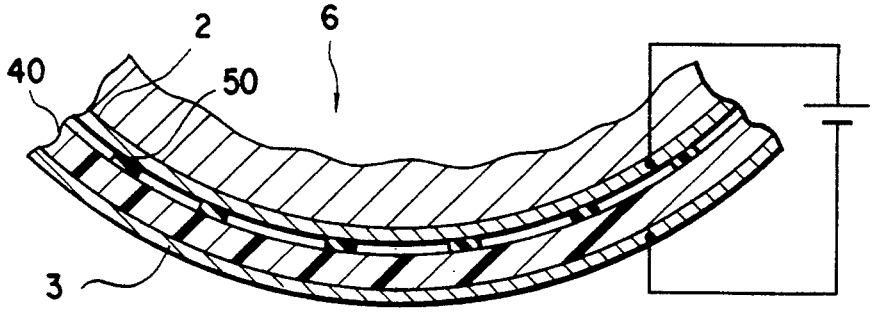
FIGS. 4A and 4B schematically show a portion of a fixing roller using a heat-generating resistor and insulating spacers.
Figure 4B:
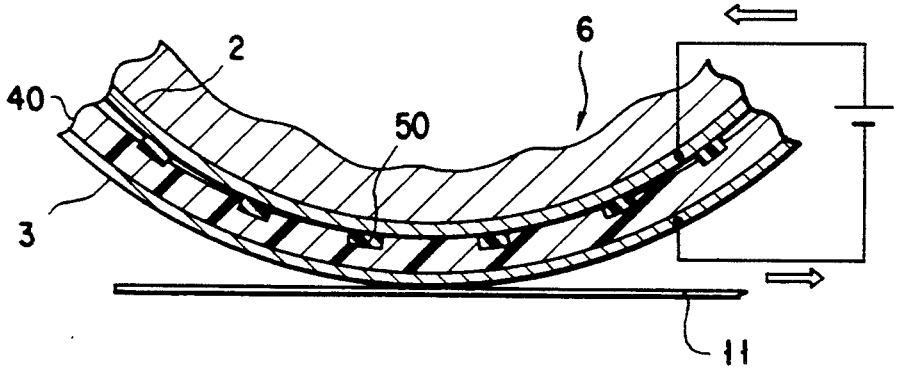

The recording apparatuses shown in FIGS. 2A and 2B use a pressure-sensitive conductive resin as the pressure-sensitive conductive switching layer. However, the present invention is not limited to this, and any material can be used as far as it can impart electrical conductivity to the pressed portion. FIGS. 4A and 4B schematically show a portion of a fixing roller using a switching layer having spacers.

As shown in FIG. 4A, a fixing roller 6 has a first electrode 2, a plurality of spacers 50 formed on the outer surface of the electrode 2 and each made of an insulating material, a heat resistant layer 40 formed on the first electrode 2 through the spacers 50, and a second electrode formed on the outer surface of the heat-generating resistor layer 40. FIG. 4A shows a state in which the fixing roller 6 is not pressed. The spacers 50 are provided to serve as a pressure-sensitive conductive switching layer and insulate the first electrode 2 and the heat-generating resistor layer 40 from each other. Hence, despite that a power source is connected between the first and second electrodes 2 and 3, a current does not flow between them in this state (OFF state).

FIG. 4B shows a state (ON state) in which the fixing roller 6 is brought into tight contact with a recording material 11. At a portion of the fixing roller 6 contacting the recording material 11, when the heat-generating resistor layer 40 made of a soft material, e.g., a conductive rubber, and the spacers 50 are pressed, the heat-generating resistor layer 40 is deformed to bury the spacers 50 therein. Thus, the heat-generating resistor layer 40 and the first electrode 2 contact with each other to flow the current in the direction indicated by hollow arrows, and the heat-generating resistor layer 40 generates heat.

In the conventional fixing method, the temperature of the entire roller having a large heat capacity is increased. In contrast to this, according to the present invention, the heat-generating resistor layer and the pressure-sensitive conductive switching layer are combined in this manner, so that only the surface of the heat roller, and furthermore only a portion of the surface of the heat roller pressed by the recording paper can be caused to concentratedly generate heat. A heat-generating resistor has a high and uniform resistivity. When the pressure-sensitive conductive resin layer is pressed, the heat-generating resistor can generate heat almost uniformly even if the distribution of the resistance of the pressure-sensitive conductive resin layer is not uniform more or less because substantially only the heat-generating resistor generates heat due to the large difference between the pressure-sensitive conductive resin layer and the heat-generating resistor. As a result, fixing non-uniformity does not easily occur. In the recording apparatus and the heating apparatus according to the present invention, the power consumption can be greatly decreased.

In the pressed portion, the temperature of the toner and the recording paper near the pressed portion must be increased so that the heat quantity generated can be sufficient to melt the toner while the toner image passes through the pressed portion. In an ordinary low-speed printer, the passing time at the pressed portion of the heat roller is several tens msec to several hundreds msec if the nip width is 0.1 to 0.2 cm depending on the recording speed. In order to heat the toner and the recording paper to a temperature (usually about 200° C.) necessary for toner fixing during this short passing time, the heat capacity of a portion near the heat-generating portion must be decreased. For this purpose, a heat-insulating layer made of a resin, e.g., having a large heat resistance may be formed inside the first conductive layer 2. The heat-insulating layer can prevent heat generated by the heat-generating resistor layer 40 from being conducted to a core roller 4. Also, the thickness of the heat-generating resistor layer may be decreased to decrease the heat capacity. The thickness of the heat generating-resistor layer 40 is preferably 1 mm or less. The thickness of a pressure-sensitive conductive resin layer 1 is preferably set to 3 mm or less, although it varies depending on the heat resistivity of the resin, and is ideally set to 1 mm or less.

In a conventional heat roller or the like, a roller having a large heat capacity is uniformly heated to serve as the fixing roller. This is to prevent the heat of the roller from being deprived of by the recording paper, while the recording paper passes through the fixing roller, to sharply decrease the resulting fixing temperature. Although to increase the heat capacity of the roller helps in increasing the fixing strength of an image, it causes an increase in power consumption. According to the present invention, since a large heat energy can be generated instantaneously, the fixing temperature is not easily decreased while the recording paper passes.

The first and second conductive layers 2 and 3 may be formed of a metal, e.g., A1, by vapor deposition. In this case, since the conductivity of the metal is very large, if the layer has a thickness of at least 1,000 Å, a sufficient current can be flowed. Also, a conductive coating material may be coated to form a conductive layer. In this case, according to a simple method, the core roller 4 may be repeatedly dipped in and pulled up from a conductive coating material several times to obtain a constant film thickness. In the latter method using the conductive coating material, since the conductive coating material does not have a conductivity so high as that of the metal, it must be coated to a thickness of several μm to several tens μm in order to sufficiently flow a current. Since the toner directly contacts the second conductive layer 3 located on the outer surface, toner offset must be prevented from occurring. When the second conductive layer 3 is formed by the method as described above, offset does not substantially occur, and even if it should occur, it will hardly adversely affect the image. Thus, the second conductive layer 3 can be used as it is to pose any problem. In order to eliminate offset completely, a layer to prevent the toner from attaching may be formed by coating, e.g., a fluoroplastic or a Teflon resin, on the outer surface of the second conductive layer 3 to a thickness of about 10 μm. Offset can also be eliminated by cleaning with a blade as that used with the conventional heat roller.

The resistivity of the heat-generating resistor layer 40 must take an appropriate value with respect to the resistivity of the pressure-sensitive conductive resin layer 1. If it is not sufficiently higher than that of the pressed portion of the pressure-sensitive conductive resin layer 1, heat generation does not concentratedly occur in the heat-generating resistor layer 40. If the pressure-sensitive conductive resin layer 1 generates heat, not only the heat generating efficiency is degraded, but also deterioration of the pressure-sensitive conductive resin layer 1 is undesirably caused. The resistivity of the heat-generating resistor layer 40 must be sufficiently lower than that of the non-pressed portion of the pressure-sensitive conductive resin layer 1. If not, the current is not concentrated on the pressed portion of the roller, thus greatly degrading the efficiency. Hence, the resistivity of the heat-generating resistor layer 40 is preferably 10 times or more that of the pressed portion and 1/10 or less that of the non-pressed portion, respectively, of the pressure-sensitive conductive resin layer 1. To satisfy this condition, the resistivity of the pressed portion of the pressure-sensitive conductive resin layer 1 must be 1/100 or less that of its non-pressed portion. The resistivity here means a resistivity per unit area. This value is obtained by multiplying a volume resistivity by a thickness. The variation in resistivity of the heat-generating resistor layer 40 must be smaller than that of the pressure-sensitive conductive resin layer 1. Since the heat-generating resistor layer 40 and the pressure-sensitive conductive resin layer 1 are electrically equivalent to a series of resistors, the synthetic resistivity is determined by the resistivity of the heat-generating resistor layer 40 which is considerably high. Therefore, whereas the resistivity of the pressure-sensitive conductive resin layer 1 that varies about twice itself will not pose much influence, the variation in resistivity of the heat-generating resistor layer 40 directly affects the amount of current flowing through it. Hence, the variation is preferably suppressed to about 10% or less.

Figure 5:
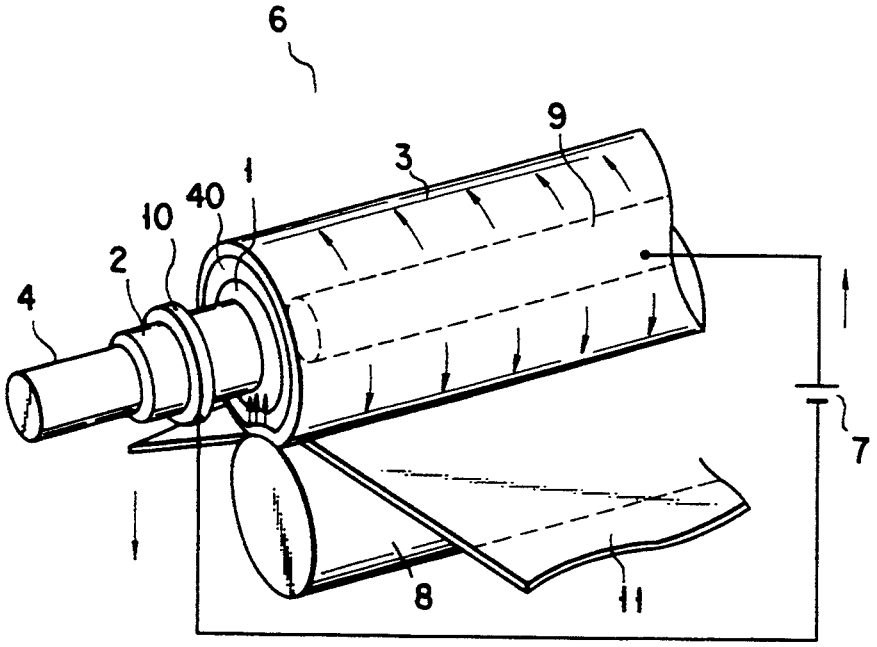
FIG. 5 schematically shows another arrangement of the recording apparatus of the present invention.

FIG. 5 is a perspective view showing a practical arrangement of the fixing apparatus based on the fixing apparatus shown in FIG. 2A. A heat insulating layer is formed on a core roller 4 serving as a shaft, and a first conductive layer 2 is formed on the heat insulating layer. A pressure-sensitive conductive resin layer 1, in which conductive particles are dispersed in silicone rubber, is formed on the first conductive layer 2, a heat-generating resistor layer 40 is formed on the pressure-sensitive conductive layer 1, and a second conductive layer 3 is formed on the resistor layer 40, thereby constituting a heat roller 6. To connect a power source to the first conductive layer 2, the first conductive layer 2 is formed wider than the pressure-sensitive conductive resin layer 1 or second conductive layer 3, and the first conductive layer 2 is partially exposed from the roller, as shown in FIG. 5. A power source 7 can be connected to the first conductive layer 2 by bringing a metal piece, a metal brush, or a metal bearing 10, as shown in FIG. 5, into contact with the exposed portion. The power source 7 can be connected to the second conductive layer 3 by bringing a metal piece, a metal brush, or a metal roller electrode 9, as shown in FIG. 5, into contact with the second conductive layer 3 provided on the surface of the heat roller 6. Recording paper 11 on which a toner image is formed is passed through between the heat roller 6 having this arrangement and a press roller 8 being in tight contact with the heat roller 6, and the power source 7 is connected, thereby performing fixing. When the power source 7 is connected as shown in FIG. 5, the current flows from the power source 7 in the order of the roller electrode 9, the second conductive layer 3, the pressed portion of the pressure-sensitive conductive resin layer 1, the first conductive layer 2, the bearing 10, and the power supply 7, as indicated by arrows in FIG. 5. Joule heat is generated at the pressed portion of the pressure-sensitive conductive resin layer 1, and the toner is fixed.

Figure 6:
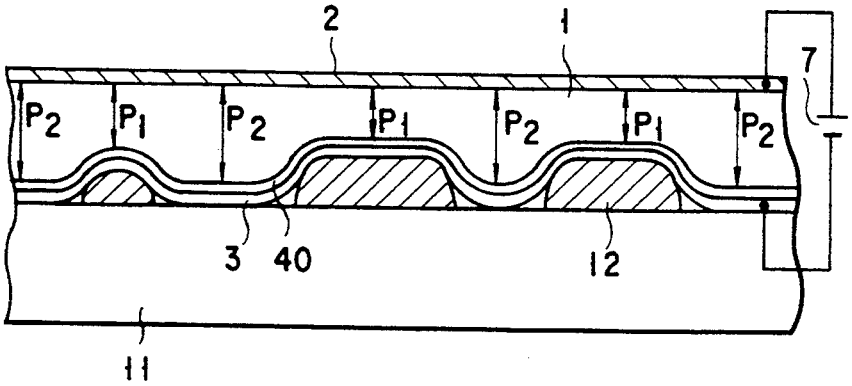
FIG. 6 schematically shows an arrangement of a fixing roller of a recording apparatus which generate heat only in the region which a toner image is present invention.

Another fixing apparatus embodying the first aspect of the present invention will be described. Regarding conservation of the fixing power, it is realized most if only a portion of the heat roller where a non-fixed toner image exists can be caused to generate heat. FIG. 6 shows a case in which the fixing apparatus described above is modified to achieve further power conservation based on this idea. As shown in FIG. 6, non-fixed toner 12 on recording paper 11 is normally deposited to a thickness of several 10 μm. This is because a normal toner has a particle size of about 10 μm and is deposited as several layers on the recording paper 11 before fixing. Even after fixing, the toner 12 usually has a thickness of about 10 μm. Thus, when an area in which the toner image 12 before fixing is pressed against a pressure-sensitive conductive resin layer 1 is enlarged, a state as shown in FIG. 6 is obtained. That is, a portion of the pressure-sensitive conductive resin layer 1 on which the non-fixed toner image 12 exists is pressed with a large force because of the deposited toner height, and the pressure at this portion becomes higher than that at a portion of the pressure-sensitive conductive resin layer 1 on which the non-fixed toner image 12 does not exist. As a result, a high pressure P1 acts on a portion where the toner attaches, and a low pressure P2 lower than the pressure P1 acts on a portion where the toner does not attach, as shown in FIG. 6, thus forming a pressure distribution on the pressure-sensitive conductive resin layer 1. In this manner, further efficient fixing can be performed by utilizing a change in pressure between a toner-present portion and a toner-absent portion.

Figure 7:
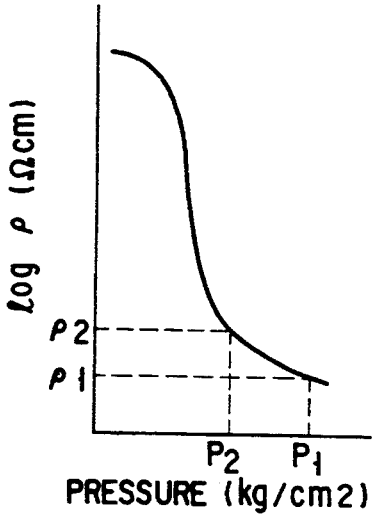
FIG. 7 is a graph showing a change in resistivity in a pressure-sensitive conductive resin used in the recording apparatus shown in FIG. 6 with regard to a pressure.
Figure 8:
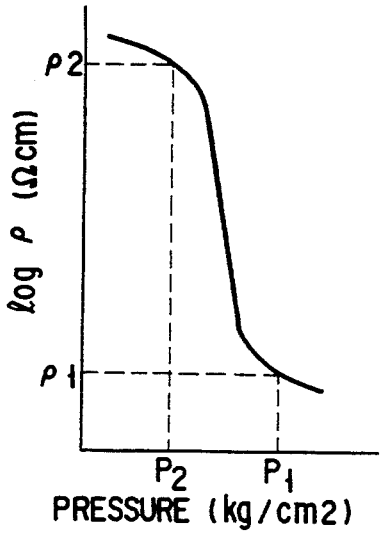
FIG. 8 is a graph showing a change in resistivity in another pressure-sensitive conductive resin used in the recording apparatus shown in FIG. 6 with regard to a pressure.

FIGS. 7 and 8 show graphs each indicating a relationship between the volume resistivity of a pressure-sensitive conductive resin and a pressure. As shown in FIG. 3, the pressure-sensitive conductive resin in the arrangements of FIGS. 2A and 2B has a pressure resistance characteristic which is saturated at constant value when a pressure is applied. In the arrangement of FIG. 6, the pressure-sensitive conductive resin is set to have such a pressure resistance characteristic that the volume resistivity $\rho$ changes depending on the pressure, as shown in, e.g., FIG. 7 even when the pressure is applied. This can be realized by appropriately selecting the type and amount of the dispersed particles. When such a pressure-sensitive conductive resin is used, since the pressure at a portion where a toner is present is P1, and since the corresponding volume resistivity is $\rho$1, and since the pressure at a toner-absent portion is P2 which is lower than P1, the corresponding volume resistivity is $\rho$2 which is higher than $\rho$1. In this state, when the power source 7 is connected between the first and second conductive layers 2 and 3, since the resistivity is lowest at the portion where the toner image 12 is present, the current flowing through it is largest, and the generated heat quantity is largest accordingly. In this case, the portion where no toner is present also generates heat. However, when compared to the case in which the pressure-sensitive conductive resin of the characteristic of FIG. 3 is used, the efficiency is improved since the heat is centralized at the portion where the toner 12 is present. Therefore, this arrangement is suited for saving power.

FIG. 8 shows a pressure resistance characteristic of a pressure sensitive conductive resin having a further improved efficiency. In this case, a volume resistivity $\rho$ of the pressure conductive resistivity sharply changes between a pressure P1 at a portion where a toner image 12 is present and a portion P2 where no toner is present. This can also be realized by appropriately selecting the type and amount of the dispersed particles. When the pressure-sensitive conductive resin having such a pressure resistance characteristic is used, the current substantially flows mostly at a portion where the non-fixed toner 12 is present, and thus most efficient, fixing with saving power can be realized. Note that in order to realize a saved-power fixing apparatus which sufficiently utilizes this characteristic, it is necessary to control the pressure. For example, in ordinary recording paper, the thickness of the paper fiber is not even and thus can lead to the surface non-evenness of about 10 μm, and this non-evenness changes the pressure. The pressure is different in a recording paper having a different thickness as well. That is, when a lowest-power fixing apparatus is fabricated by utilizing the characteristic shown in FIG. 8, the obtained apparatus can be used in recording apparatus which performs recording on exclusive paper, e.g., a resin sheet, which has no surface non-evenness and change in thickness. In this case, since only a portion where the toner is present generates heat, the fixing efficiency is the best. The present invention has been described above by referring to cases in which a pressure-sensitive conductive resin is formed to have a roller-shape and is used. A case will be described in which a sheet-shaped pressure-sensitive conductive resin is used.

According to the third aspect of the present invention, there is provided a recording apparatus comprising heating means constituted by a fixing sheet having a first conductor, a pressure-sensitive conductive switching layer a region of which can be conducted upon being pressed, a heat-generating resistor layer formed on the pressure-sensitive conductive switching layer, and a second conductor formed on the heat-generating resistor layer, wherein the fixing sheet is partially brought into tight contact with a material to be heated, and a voltage is applied across the first and second conductors, so that a current flows in the pressed region of the pressure-sensitive conductive switching layer in order to generate Joule heat, thereby fixing a toner image on the material by using the Joule heat.

Figure 9:
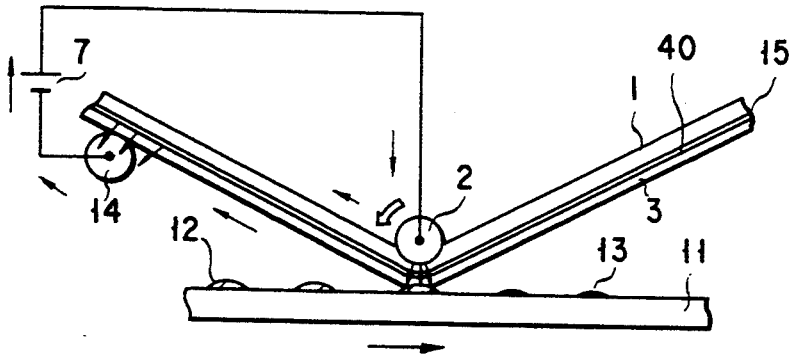
FIG. 9 schematically shows another arrangement of a recording apparatus provided with a fixing sheet which uses a heat-generating resistor.

FIG. 9 shows a fixing apparatus using a sheet-shaped pressure-sensitive conductive resin layer 1. A fixing sheet 15 in which a heat-generating resistor layer 40 is formed on one surface of the pressure-sensitive conductive resin layer 1 and a second conductive layer 3 is formed on the heat-generating resistor layer 40 is used in this fixing apparatus. The conductive layer 3 may be formed by depositing metal, e.g., aluminum, by vapor deposition or by coating a conductive coating composition. The fixing sheet 15 is arranged such that the second conductive layer 3 opposes a surface of recording paper 11 on which a toner image 12 is formed. A roller made of, e.g., a metal as a first conductor 2 is pressed on the other surface of the fixing sheet 15 against the recording paper 11, on which the non-fixed toner image 12 is formed, through the medium of the fixing sheet 15. The first conductor 2 is connected to one terminal of a power source 7. The second conductive layer 3 is brought into contact with a conductive piece, a conductive brush, or a metal roller electrode 14, as shown in FIG. 9. The roller electrode 14 is connected to the other terminal of the power source 7. The fixing apparatus is thus constituted. Since a pressure is applied to the fixing sheet 15 by the metal roller as the first conductor 2, the resistivity at this portion is decreased, and a current flows mostly in this pressed portion. A current flows along the path indicated by thin arrows in FIG. 9, the pressed portion of the heat-generating resistor layer 40 generates heat, and the toner image 12 on the recording paper 11 is fixed by this heat, thereby forming a fixed image 13. The metal roller as the first conductor 2 is moved in a direction indicated by thick black arrows relative to the fixing sheet 15 together with the roller electrode 14 while it is rotated on the fixing sheet 15 in a direction indicated by a thick white arrow, thereby fixing the toner on the entire recording paper 11.

Figure 10:
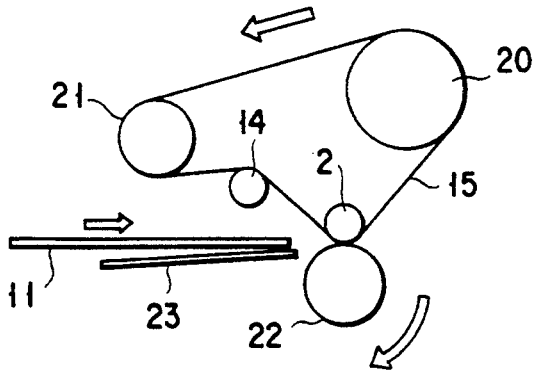
FIG. 10 shows an arrangement of a recording apparatus using an endless belt-type fixing sheet.

FIG. 10 is a view schematically showing an arrangement of a fixing apparatus which uses the sheet-shaped fixing apparatus 15. The fixing sheet 15 used in this fixing apparatus has a similar structure as that shown in FIG. 9 and is obtained by forming a heat-generating resistor layer on one surface of a pressure-sensitive conductive resin sheet and forming a conductive layer on the heat-generating resistor layer. An endless belt is formed of such a fixing sheet 15, and is looped among three rollers including drive roller 20, a tension roller 21, and a first conductor 2, as shown in FIG. 10. The fixing sheet 15 is driven by the drive roller 20 to travel as indicated by a hollow arrow. The tension roller 21 applies a predetermined tensile force to the traveling fixing sheet 15 so that the fixing sheet 15 does not become loose. The first conductor 2 is pressed against a backup platen 22 through the medium of the fixing sheet 15, and the backup platen 22 is rotated in synchronism with the fixing sheet 15, as indicated by another hollow arrow. Recording paper 11, on which a toner image is formed, is fed from a previous step to the fixing apparatus, as indicated by still another hollow arrow. Then, the recording paper 11 is guided by a paper guide 23 to pass through the pressed portion between the fixing sheet 15 and the backup platen 22. A metal roller electrode 14 contacts a surface of the fixing sheet 15 on which the conductive layer is formed, and a voltage is applied across the first conductor 2 and the conductive layer of the fixing sheet 15. When the recording paper 11 enters the pressed portion between the fixing sheet 15 and the backup platen 22, a voltage is applied across the first conductor 2 and the roller electrode 14. Since the pressed portion has a low resistance, a current flows through this pressed portion, and the toner on the recording paper 11 is fixed. Since the fixing sheet 15 is endless and driven by the drive roller 20 as indicated by the arrow, the heat-generating pressed portion continuously travels over the fixing sheet 15. Fixing can be performed on the entire surface of the recording paper in this manner. The surface of the fixing sheet 15 which contacts the electrode 14 directly contacts the toner. When a conductive layer on which aluminum or the like is deposited by vapor deposition is used, a toner offset which affects subsequent recording does not substantially occur. In order to prevent the influence of the toner offset more effectively, a cleaning apparatus using a blade as used in a conventional heat roller can be used. The offset can also be prevented by coating the surface of the fixing sheet 15 which contacts the toner with, e.g., fluoroplastic. In this case, however, the roller electrode 14 cannot contact the conductive layer of the fixing sheet 15. Therefore, it is preferable to think out a way with which the roller electrode 14 contacts the fixing sheet 15. For example, the width of the fixing sheet 15 may be set larger than that of the recording paper, only a portion of the fixing sheet 15 which contacts with the recording paper may be coated with a resin, and the roller electrode 14 may be brought into contact with a non-coated portion of the fixing sheet 15.

To use such a fixing sheet in a fixing apparatus is disadvantageous in terms of size reduction when compared to a fixing roller. In the roller type fixing apparatus, however, the heat generated on the roller surface is not sufficiently insulated even if a heat insulating layer is provided in the roller, and the heat tends to be conducted to the core of the roller to cause a thermal loss. In comparison to this, when a fixing sheet is used, the power consumption can be further economized since the fixing sheet is perfectly held in the air.

Figure 11:
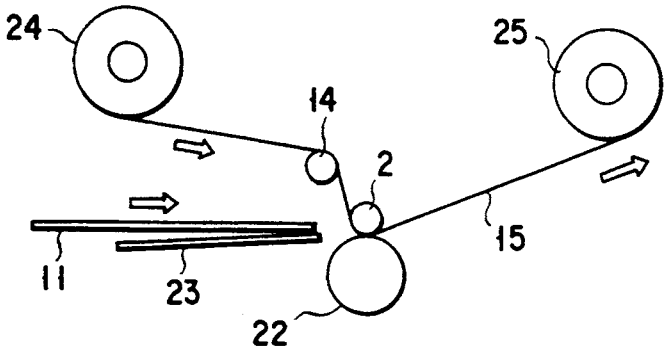
FIG. 11 shows an arrangement of a recording apparatus using a roll-type fixing sheet.

FIG. 11 shows another arrangement of a fixing apparatus using a fixing sheet 15. In FIG. 9, the endless belt-shaped fixing sheet 15 is used. In FIG. 11, a rolled fixing sheet 15 is used. The fixing sheet 15 is wound on a supply reel 24. The fixing sheet 15 first contacts a roller electrode 14, passes through a pressed portion between a first conductor 2 and a backup platen 22, and is taken up by a take-up reel 25. The fixing sheet 15 is taken up by the take-up reel 25 in synchronism with a timing at which recording paper 11 on which a non-fixed toner image is formed passes through the pressed portion of the first conductor 2, fixing sheet 15 and the backup platen 22. To use such a rolled fixing sheet is advantageous in that a fixing sheet can be fabricated by using an inexpensive material having a low heat-resisting property. If a fixing roller or endless belt is used, the pressure conductive sheet need to have a service life almost the same as that of the recording apparatus itself. In contrast to this, when a rolled fixing sheet as described above is used, it is disposable after being used once, and thus a material having a low heat-resisting property or a thin fixing sheet can be used. If the fixing sheet is of a type which can be used several times, when fixing on one or several continuous sheets of recording paper is completed, the fixing sheet is rewound, used until a service life is reached, and replaced by a new new fixing sheet, thereby minimizing the amount of the fixing sheet used. If the fixing sheet is of a type which can be used ten times. when fixing on one recording paper is completed, the fixing sheet is rewound by a length corresponding to 9/10 a single recording sheet, and one fixing sheet is used ten times in this manner, thereby economizing the fixing sheet. Note that when a rolled fixing sheet as shown in FIG. 10 is used, it needs replacement. Therefore, it is preferable that a fixing sheet roll is fabricated as a cassette so that it can be easily replaced.

Figure 12:
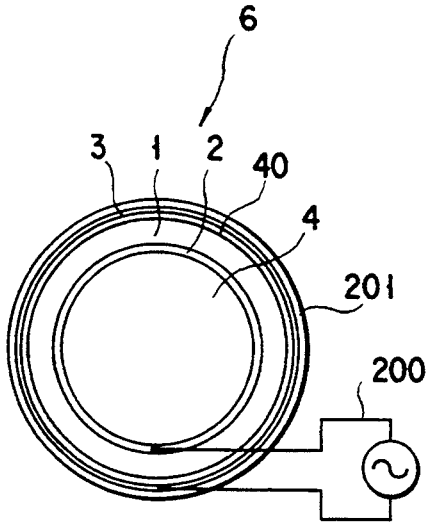
FIG. 12 shows an arrangement of a recording apparatus using an AC power source.

In the embodiments described above, a DC power source is used as the power source for fixing. However, the power source for fixing is not limited to a DC power source but can be an AC power source. FIG. 12 shows an arrangement of a recording apparatus which uses an AC power source. This recording apparatus has a structure almost similar to that shown in FIG. 2A except that it uses an AC power source 200 in place of a DC power source and that an offset preventive layer 201 is additionally formed on the surface of the fixing roller.

Each of the recording apparatuses in the above embodiments uses a DC power supply as it is directed to a small electrophotographic recording apparatus which has a small power consumption, which can use a cell as a power source, and which can be driven at any place. However, if a recording apparatus is to be used at a place where a 100 V power source is available, it can use an AC power source. A commercial 100 V power source can be used most easily as the AC power source. This voltage of 100 V can be decreased by using such as transformer corresponding to the resistivity of a conductive member, thus optimizing heat generation in the conductive member.

Figure 13:
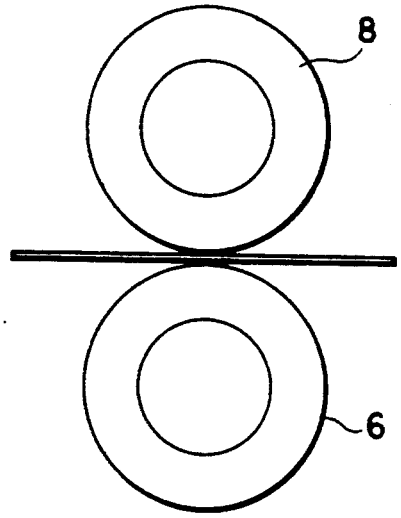
FIG. 13 shows a fixing means for heating recording paper from a rear side.

FIG. 13 shows a recording apparatus which performs fixing by heating recording paper from a side opposite to a side where the toner is transferred. As shown in FIG. 13, in this recording apparatus, a press roller 8 and a fixing roller 6 are provided upside down when compared to those shown in FIG. 2A. Namely, the fixing roller 6 is provided on the toner side of the recording paper, and the press roller 8 is provided on the opposite side of the recording paper. These two rollers 6 and 8 are brought into tight contact with each other through the recording paper, and a current is flowed to the pressure-sensitive conductive rubber to cause the pressed portion to generate heat, thereby fixing the toner by heating the recording paper from its opposite side. When compared to the recording apparatus in which the recording paper is heated from the toner side, the heat is not efficiency conducted to the toner since the recording paper is present between the toner and the fixing roller 6, and thus this method is not suitable for high-speed fixing. However, with this method as well, the toner can be sufficiently fixed, and if recording paper having a high heat conductivity is used, efficient fixing can be performed even if the recording paper is heated from the opposite side. Even when ordinary recording paper is used, if the fixing time is sufficiently increased or the heat-generating energy is sufficiently increased, the recording paper is sufficiently heated, thereby sufficiently fixing the toner.

Figure 14:
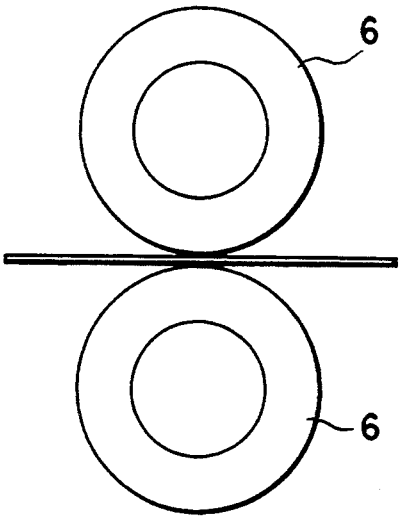
FIG. 14 shows a fixing means for heating recording paper from both sides.

FIG. 14 shows a recording apparatus using a pair of fixing rollers as an improvement over the rollers of FIG. 13. As shown in FIG. 14, in this recording apparatus, two fixing rollers 6 each identical to that used in the apparatus of FIG. 2A are used, and recording paper on which the toner is transferred is introduced between the rollers 6 and partially pressed. This apparatus is suitable for higher-speed recording than recording by the recording apparatus using only one fixing roller.

As has been described above, the fixing roller may be provided on the toner side of the recording paper, the opposite side of the recording paper, or the two sides of the recording paper. In any case, since only the pressed portion of the conductive member generates heat, a recording apparatus having a shorter warm-up time and higher efficiency than in the conventional heat roller type can be realized.

Figure 15:
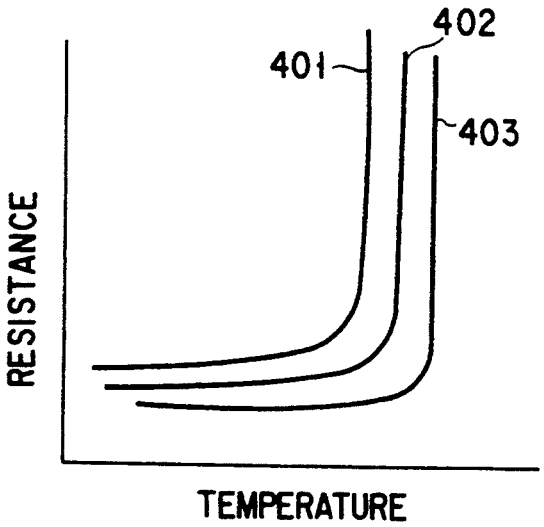
FIG. 15 is a graph showing a change in resistivity in a pressure-sensitive conductive resin used in the present invention with regard to a temperature.

A typical example of the pressure-sensitive conductive resin includes a pressure conductive rubber. A pressure conductive rubber obtained by dispersing in a silicone rubber a conductive material, e.g., particles of carbon black or a nickel-based metal, or spherical metal particles of, e.g., copper or nickel, can be used. To obtain an appropriate resistivity, the dispersion amount may be controlled, or carbon black and metal particles may be mixed at an appropriate dispersion ratio. FIG. 3 is a graph showing a change in resistivity in a pressure-sensitive conductive resin used in the present invention against a pressure. FIG. 15 is a graph indicating a relationship between a temperature and a resistance of a pressure-sensitive conductive resin. In FIG. 15, the pressure is increased in the order of curves 401, 402, and 403. A major feature of the pressure conductive rubber resides in an acute increase in resistance at a specific temperature when the temperature is increased as shown in FIG. 15. This is assumed to be caused by a change in thermal expansion coefficient between the rubber and the dispersed conductive material particles. That is, when the temperature is increased, only the rubber portion expands, and the distance between dispersed particles is increased, resulting in a sharp increase in resistance. When the pressure is increased, the temperature at which this sharp increase occurs is increased.

The present invention positively utilizes such a feature of the pressure-sensitive conductive resin. That is, when the temperature is low at the initial stage of heat generation, the resistance is low, and thus a large current can be supplied, thereby generating a large amount of heat instantaneously. Therefore, the heat will not be deprived of by the recording material to destabilize fixing, as described above. When the temperature is gradually increased to exceed a predetermined value, the resistance is sharply increased so that the current cannot flow easily. Since the temperature can be self-controlled in this manner, the fixing apparatus is not excessively heated, and the fixing temperature can be substantially stabilized.

According to the fourth aspect of the present invention, there is provided a recording apparatus comprising power supply means having a first electrode and a second electrode aligned with the first electrode, and a conductive member which is in slidable contact with the power supply means, wherein the conductive member and a recording material having a conductive toner image are partially brought into contact with each other, and a voltage is applied across the first and second electrodes, so that a current flows in the conductive toner image to generate Joule heat, thereby fixing the toner image by using the Joule heat.

Figure 16:
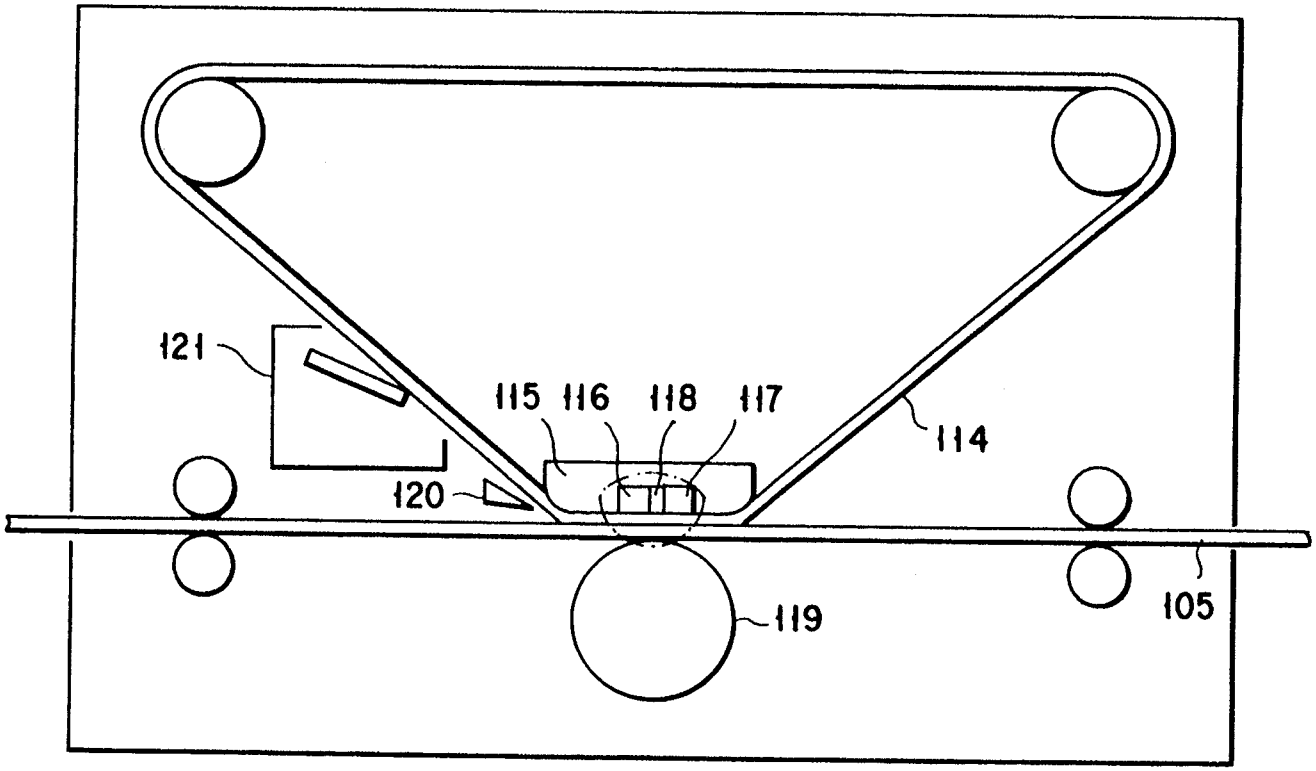
FIG. 16 shows an arrangement of a fixing unit which is powered to fix a toner by using an anisotropic conductive member.

FIG. 16 shows a fixing apparatus for use in a recording apparatus according to the invention using an anisotropic conductive member and a conductive toner.

As shown in FIG. 16, a fixing unit 113 has an endless belt-like anisotropic conductive member 114, a power supply unit 115 provided on the anisotropic conductive member 114, and a press roller 119 opposing the power supply unit 115 through the anisotropic conductive member 114. A transfer material can be introduced between the press roller 119 and the anisotropic conductive member 114, and the anisotropic conductive member 114 and the transfer material can be partially brought into tight contact with each other from the both sides. The anisotropic conductive member 114 is supported at three points, i.e., two turn rollers and the power supply unit 115, and rotated in one direction. Except for the endless-belt like anisotropic conductive member, for example, a roller member having anisotropic conductiveness in the radial direction can be used as the anisotropic conductive member 114. A cleaning unit 121 is provided on the outer surface of the anisotropic conductive member 114 to clean the toner from the transfer member. A separation pawl 120 for separating the anisotropic conductive member 114 and the transfer material from each other is provided downstream from the pressed portion of the anisotropic conductive member 114. A power supply electrode head 116 and a return path electrode 117 are arranged in the power supply unit 115 to sandwich an insulating spacer 118 in the sub-scanning direction.

Figure 17:
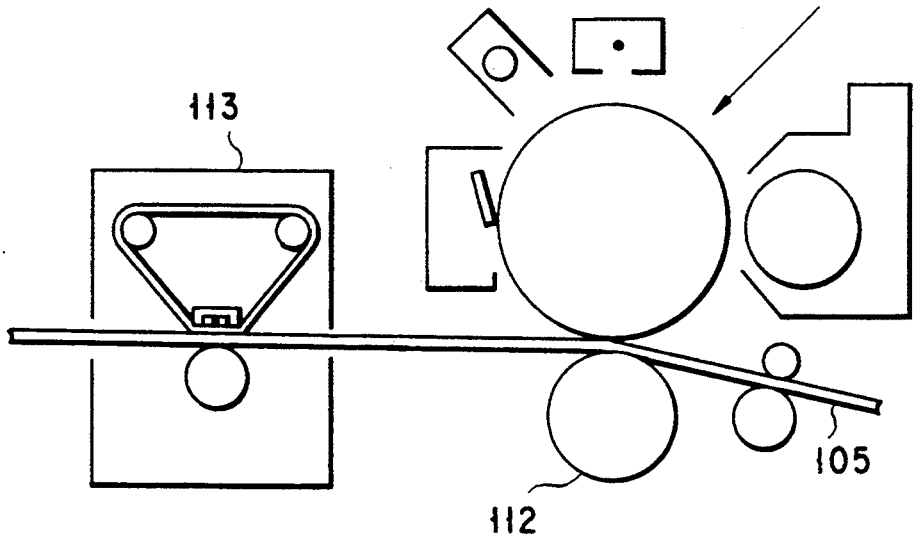
FIG. 17 Shows an arrangement of a recording apparatus applying pressure transfer.

The fixing unit 113 having the arrangement described above is provided downstream from the transfer unit, as shown in FIG. 17. To flow a current to the toner to generate heat, the lower the resistance of the toner, the better. However, a toner having a low resistance cannot be developed by a magnetic brush. Hence, this fixing apparatus employs the magne-dynamic method utilizing the electrostatic dielectric phenomenon. This fixing apparatus performs pressure transfer/fixing by applying a pressure to a transfer roller 112 without using electrostatic transfer in which charges are supplied by a transfer charger and a separation charger. This is because if electrostatic transfer is performed, the charges leak through the recording paper since the resistivity of the toner is low.

In the fixing unit 113, power is supplied to the toner transferred upon pressure to the recording paper to generate Joule heat, thus melting and fixing the toner. This is because in pressure transfer/fixing, the toner does not penetrate into the fibers of the recording paper to provide a low fixing rate. Fixing may not also performed in pressure transfer. In this case, although the transfer efficiency is slightly decreased by a decrease in pressure, undesirable continuation of edges of a recording image is decreased, and the gross of the recording image and the recording paper is greatly decreased.

Figure 18:
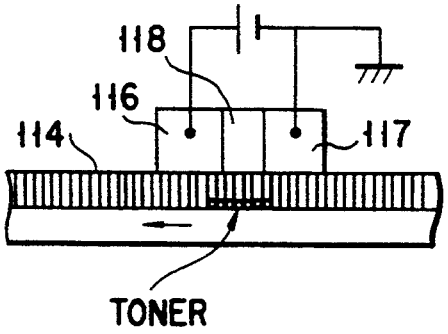
FIG. 18 schematically shows the state of the toner at the fixing unit of the recording apparatus shown in FIG. 16.

Recording paper 105 on which a recording image is transferred upon pressure by the transfer roller 112 is pressed by the anisotropic conductive member 114 in the vicinity of the power supply unit 115. FIG. 18 schematically shows a state in which the toner is fixed on the recording paper 105. A voltage is applied across the electrode head 116 and the return path electrode 117. When the toner image enters between the electrode head 116 and the return path electrode 117, a current path as shown in FIG. 18 is formed, and a current flows in the toner. The toner is melted by the Joule heat caused by this current to penetrate into the recording paper 105 by a pressure by means of the press roller 119, and is fixed. Substantially no current flows in a toner-free portion of the recording paper 105 because of the good insulating characteristic of the surface of the recording paper 105. Thus, substantially no energy is consumed except for melting the toner, and very efficient fixing can be performed. In this description, the fixing unit 113 is used as a fixing unit of an electrophotographic recording apparatus. However, the present invention is not limited to this, and this fixing unit 113 can be used to thermally transfer or fix an image on an intermediate medium to another medium. For example, when an image is to be formed on an intermediate medium by ink-jet recording and the image on the intermediate medium is to be transferred and fixed on the recording paper, the anisotropic conductive member 114 can be used as the intermediate medium, and the power supply unit 115 can be used as the heating means.

The recording paper 105 passing through the power supply unit 115 is separated from the anisotropic conductive member 114 by the separation pawl 120 and discharged from the fixing unit 113. Some toner remains on the anisotropic conductive member 114 unless the transfer efficiency is 100%. Thus, the cleaning unit 121 using a blade may be mounted on the anisotropic conductive member 114.

Figure 19:
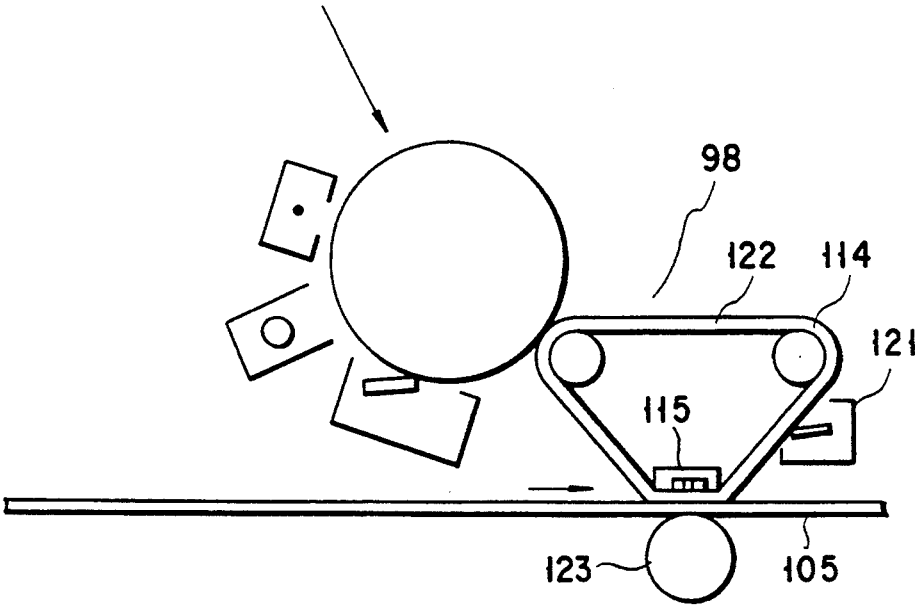
FIG. 19 shows an arrangement of a recording apparatus applying adhesion transfer.

FIG. 19 shows a recording apparatus employing the adhesion transfer method. In the same manner as in FIG. 17, a conductive magnetic toner is used, and the magne-dynamic method is used for developing. In the recording apparatus adhesion-transferring and fixing can be performed using a fixing unit 98. The fixing unit 98 has an arrangement almost similar to that of the arrangement shown in FIG. 16. An intermediate transfer member 122 constituted by an endless belt-shaped anisotropic conductive silicon rubber member and having an adhesive and releasable surface is used as the anisotropic conductive member. A developed toner image is adhesion-transferred (primary transfer) to the intermediate transfer member 122. The transfer efficiency of the primary transfer depends on the hardness of the intermediate transfer member 122. When the hardness is decreased, the transfer efficiency is increased. Although the transfer efficiency reaches 95% when the hardness is 20°, the hardness is set to 35x by considering the durability of the rubber.

The toner image adhesion-transferred to the intermediate transfer member 122 is transferred and fixed (secondary transfer) on recording paper 105 by melting. At this time, the toner components penetrate into the recording paper 104 upon application of the pressure by a press roller 123, and are fixed. To melt the toner, power is supplied to the toner by using the power supply unit 115, in the same manner as in the embodiment shown in FIG. 16, and the Joule heat generated by the powered toner is utilized for melting. Part of the toner is not fixed on the recording paper 105 but remains on the intermediate transfer member 122. Therefore, a cleaning unit 121 using a blade is mounted on the intermediate transfer member 122. The intermediate transfer member 122 is heated to a high temperature after fixing. Hence, the path from the secondary transfer unit to the primary transfer unit is set long so that the intermediate transfer member 122 is sufficiently cooled until the next primary transfer operation. However, a cooling unit using a heat sink or the like can be separately provided.

Figure 20:
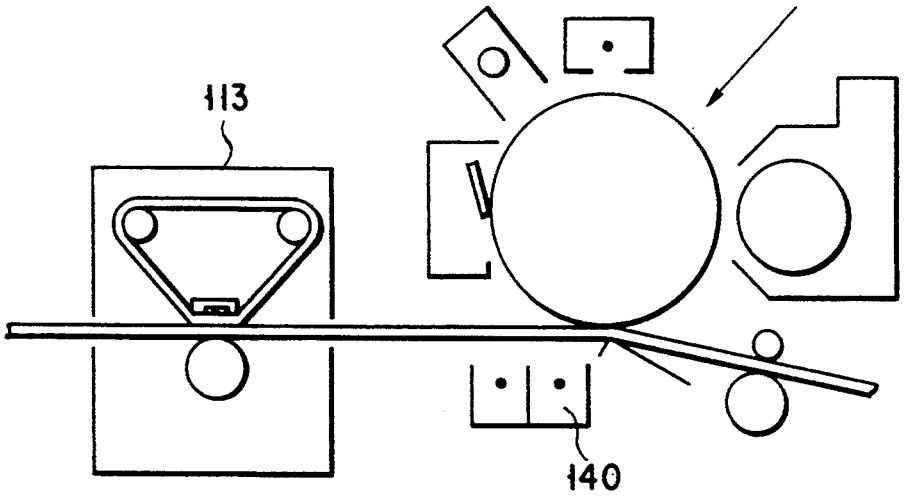
FIG. 20 shows an arrangement of a fixing unit using insulating paper as the recording paper.

Another embodiment according to the fourth aspect of the present invention is shown in FIG. 20. An image is fixed by using a recording apparatus shown in FIG. 20 and insulating paper as the recording paper. This apparatus has substantially the same arrangement as that of the recording apparatus shown in FIG. 17 except that it uses a transfer charger 140 in place of the transfer roller 112 of the transfer unit.

In electrostatic recording using this apparatus, a toner image is transferred to the recording paper in accordance with electrostatic transfer using the transfer charger 140 due to the following reason. That is, since the insulating paper having an insulation-treated surface is used as recording paper 105, the charges of the conductive toner do not leak to the recording paper 105, and toner scattering does not occur much even if electrostatic transfer is performed.

As the conductive toner, a toner obtained by adjusting the ratio of the magnetic particles of a magnetic one-component toner and internally or externally adding carbon black to provide a desired conductivity can be used. Carbon black is used as a coloring agent and an electric resistance adjusting agent for a variety of toners ranging from a conductive toner to an insulating toner.

As the fixing member having an anisotropic conductivity in the direction of thickness, for example, a fixing member obtained by dispersing a conductive filler, e.g., metal wires or carbon fibers, that exhibits conductivity only in a predetermined direction, in a general-purpose rubber, an urethane resin, or silicone rubber may be used.

Although several arrangements of the present invention have been described, the present invention is not limited to them. According to the present invention, e.g., a pressure-sensitive conductive resin is used, the pressure-sensitive conductive resin is pressed against recording paper on which toner image is formed, a current is supplied mostly to the pressed portion, and the toner is fixed by utilizing Joule heat which is generated in the pressure-sensitive conductive resin by the current. The fixing apparatus of the present invention can be of any type as far as it aims at generation of Joule heat mostly at the pressed portion, in this manner, and is not limited to the arrangements described above.

The power source for supplying a current to the pressure-sensitive conductive resin need be connected only while the recording paper on which a non-fixed toner image is formed passes through the fixing apparatus. That is, in the conventional heat roller method, it takes time to increase the temperature of the heat roller to a toner fixing capable temperature. Therefore, preheating must be performed even when no recording paper is fed, and the entire roller must always be heated, even during a wait time, by occasionally supplying power to the heater. In contrast to this, according to the fixing method or the present invention, since only a surface of the roller, and especially a portion thereof which is pressed by the recording paper can be instantaneously heated, the roller need be caused to generate heat only while the recording paper passes through the fixing apparatus, thereby performing fixing. In this respect as well, sufficient saving power, when compared to the conventional fixing method. can be realized. In the fixing apparatus of the present invention, since the temperature of the roller surface can be instantaneously increased up to the toner fixing enable temperature, further saving power is possible. That is, it is not that the power source for supplying a current to the pressure-sensitive conductive resin is connected only while the recording paper passes. Rather, fine control is performed and the power source is connected only when a non-fixed toner image is present on the recording paper, so that further saving power can be realized. In particular, when the fixing apparatus of the present invention is used in a laser printer or the like, substantially blank recording paper with a very small recording amount is sometimes output. In this case, the fixing energy need only be applied to only the portion where the recording image is present. In this manner, when the fixing power source is connected only when an image is present, further saving power becomes possible. ON/OFF control of heat generation is realized by, e.g., detecting image data in a memory if the fixing apparatus is used in a laser printer.

As has been described above, according to the present invention, e.g., a member obtained by sandwiching two opposite surfaces of a pressure-sensitive conductive resin and a heat-generating resistor layer formed thereon with first and second conductors can be used as a heating means. Typically, one of the conductors formed on the heat-generating resistor layer is arranged on a material to be heated such as a recording material. When this heating member and a recording material on which a toner image is formed are partially brought into tight contact with each other, the resistance in a pressed portion of the pressure-sensitive conductive resin is decreased, and the volume resistivity of this portion becomes, e.g., $10^3$ [Ω·cm] or less. In contrast to this, the volume resistivity of a non-pressed portion remains at, e.g., $10^8$ [Ω·cm] or more. Therefore, when a voltage is applied across the first and second conductors described above, it flows mostly to the low-resistance pressed portion through the pressure-sensitive conductive resin.

The member obtained by sandwiching such a pressure-sensitive conductive resin and the heat-generating resistor with two conductive layers is applied on, e.g., a roller surface to constitute a heat roller, and a backup roller is pressed against the heat roller. When a voltage is applied across the two conductive layers of the heat roller, a current flows through the pressure-sensitive conductive resin, so that the heat roller surface is caused to generate Joule heat. When a recording material on which a non-fixed toner image is formed is passed through the heat and backup rollers, fixing is performed.

In the fixing apparatus having the above-described configuration, since the heat and backup rollers are partially pressed against each other through the recording material, a current flows mostly to this pressed portion. That is, mostly a portion of the pressure-sensitive conductive resin of the heat roller which contacts the recording material generates heat. The toner on the recording material is fixed by this heat. Since the heat roller is rotated, the portion which mostly generates heat is sequentially shifted on the roller. In the fixing apparatus using the conventional heat roller, the heat roller is internally heated to increase the temperature of the entire roller, thereby performing fixing. When compared to this conventional method, according to the fixing apparatus of the present invention, only the surface of the heat roller, and especially a portion thereof which contacts the recording material is caused to generate heat to perform fixing. Therefore, energy required for fixing can be greatly saved.

The thickness of the toner-present portion is larger than that of the toner-absent portion by an amount corresponding to the height of the coated toner. Therefore, when the recording material is pressed between the heat and backup rollers, the pressure acting on the toner-present portion becomes larger than that on the toner-absent portion. Accordingly, the resistance across the first and second conductive layers becomes smallest at the toner-present portion, and mostly the toner-present portion generates heat. Further efficient fixing can be realized in this manner.

When efficient fixing is realized in this manner, power can be saved. Furthermore, in a normal operating state, the warm-up time can be decreased nearly to 0.

The resistance of the pressure-sensitive conductive resin used in the present invention has the temperature characteristic as shown in FIG. 15. When a local temperature drop occurs in such a pressure-sensitive conductive resin due to a variation in resistance, thickness, outer air, or by an object that contacts the pressure-sensitive conductive resin, power source is controlled to be supplied until the temperature becomes a predetermined value at this portion. When the fixing apparatus of the present invention is used, the temperature distribution of the surface of the powered pressure-sensitive conductive resin is kept uniform in this manner. As a result, fixing non-uniformity does not occur. Similarly, since the fixing apparatus has a characteristic to self-control its temperature at an paper limit, ignition or a sticking phenomenon that the toner is fused on the roller, both of which are caused by an excessive temperature increase, can be prevented.

In addition, according to the present invention, when the pressure-sensitive conductive resin is used, the heat-generating portion itself need not have a heat capacity, but only a pressed portion pressed by the recording material need to generate heat. When the temperature does not increase, the resistances of the pressed and non-pressed portion are different by 10,000 to 100,000 times. Therefore, a current can be efficiently supplied to only a needed portion, and when a maximum current is supplied to the pressed portion, the fixing apparatus can be started more quickly. Furthermore, since the heat-generating method of the fixing apparatus of the present invention is of the pin-point heat generation type in which heat is supplied to only the nip width or to a small area comprising of the toner-present portion, the heat quantity to be deprived of is small, and good fixing can be performed to color copy paper having a thick toner layer or a recording material having a high moisture amount as well.

Furthermore, according to the present invention, when the respective recording apparatuses described above and the conductive toner are combined, the conductive toner itself can be heated by its Joule heat. In this manner, when the conductive toner is used, apparently highly efficient heat generation can be performed.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A heating apparatus comprising heating means having a first conductor, a pressure-sensitive conductive switching layer formed on said first conductor and a region of which can be conducted upon being pressed, a heat-generating resistor layer formed on said pressure-sensitive conductive switching layer, and a second conductor formed on said heat-generating resistor layer, wherein said heating means and a material to be heated are partially brought into tight contact with each other, and a voltage is applied across said first and second conductors, so that a current flows in said pressed region of said pressure-sensitive conductive switching layer and a portion of said heat-generating resistor layer around said region to generate Joule heat, thereby heating the object to be heated by using the Joule heat.

2. An apparatus according to claim 1, wherein a pressure-sensitive conductive resin is used to form said pressure-sensitive conductive switching layer.

3. An apparatus according to claim 1, wherein said pressure-sensitive conductive resin consists essentially of pressure-sensitive conductive rubber.

4. An apparatus according to claim 1, wherein said pressure-sensitive conductive switching layer comprises a plurality of electrically insulating spacers.

5. An apparatus according to claim 4, wherein conductive rubber is used to form said heat-generating resistor layer.

6. An apparatus according to claim 1, wherein said heating means is a heat roller obtained by laminating a pressure-sensitive conductive resin layer, said heat-generating resistor layer, and said second conductor on said first conductor which has a solid roller-shape or a hollow roller-shape.

7. An apparatus according to claim 1, wherein said heating means is a heat roller obtained by laminating a pressure-sensitive conductive resin layer, said heat-generating resistor layer, and said second conductor on said first conductor which is formed on a solid roller or a hollow roller.

8. An apparatus according to claim 1, wherein said second conductor has a structure in which a metal is deposited on said heat-generating resistor layer by vapor deposition.

9. A recording apparatus comprising heating means having a first conductor, a pressure-sensitive conductive switching layer formed on said first conductor and a region of which can be conducted upon being pressed, a heat-generating resistor layer formed on said pressure-sensitive conductive switching layer, and a second conductor formed on said heat-generating resistor layer, wherein said heating means and a recording material to be heated are partially brought into tight contact with each other, and a voltage is applied across said first and second conductors, so that a current flows in said pressed region of said pressure-sensitive conductive switching layer and a portion of said heat-generating resistor layer around said region to generate Joule heat, thereby fixing a toner image on the recording material by using the Joule heat.

10. A recording apparatus comprising heating means constituted by a fixing sheet having a first conductor, a pressure-sensitive conductive switching layer a region of which can be conducted upon being pressed, a heat-generating resistor layer formed on said pressure-sensitive conductive switching layer, and a second conductor formed on said heat-generating resistor layer, wherein said fixing sheet is partially brought into tight contact with a recording material to be heated, and a voltage is applied across said first and second conductors, so that a current flows in said pressed region of said pressure-sensitive conductive switching layer and a portion of said heat-generating resistor layer around said region to generate Joule heat, thereby fixing a toner image on the recording material by using the Joule heat.

11. An apparatus according to claim 10, wherein said second conductor has a structure in which a metal is deposited on a heat-generating resistor layer by vapor deposition.

12. An apparatus according to claim 10, wherein said fixing sheet is pressed by a metal roller on the recording material.

13. An apparatus according to claim 10, wherein said fixing sheet is an endless belt.

14. An apparatus according to claim 10, wherein said fixing sheet is wound on a reel to form a roll.

15. A recording apparatus comprising power supply means having a first electrode and a second electrode aligned with said first electrode, and a pressure-sensitive conductive member which is in slidable contact with said power supply means, wherein said conductive member and a recording material having a conductive toner image are partially brought into contact with each other, and a voltage is applied across said first and second electrodes, so that a current flows to generate Joule heat, thereby fixing the toner image on the recording material by using the Joule heat.

16. A recording apparatus comprising power supply means having a first electrode and a second electrode aligned with said first electrode, and a conductive member which is in slidable contact with said power supply means and which comprises a member having anisotropic conductivity in a direction of thickness, wherein said conductive member and a recording material having a conductive toner image are partially brought into contact with each other, and a voltage is applied across said first and second electrodes, so that a current flows to generate Joule heat, thereby fixing the toner image on the recording material by using the Joule heat.

* * * * *